United States Patent [19]

Toriuchi et al.

[11] Patent Number: 4,720,446

[45] Date of Patent: Jan. 19, 1988

[54] COLOR PHOTOGRAPHIC LIGHT-SENSITIVE MATERIAL

[75] Inventors: Masaharu Toriuchi; Osamu Takahashi, both of Kanagawa, Japan

[73] Assignee: Fuji Photo Film Co., Ltd., Kanagawa, Japan

[21] Appl. No.: 858,775

[22] Filed: May 2, 1986

[30] Foreign Application Priority Data

May 2, 1985 [JP] Japan ..... 60-95241

[51] Int. Cl.[4] ..... G03C 5/54; G03C 1/40

[52] U.S. Cl. ..... 430/213; 430/203; 430/941

[58] Field of Search ..... 430/213, 941, 203

[56] References Cited

U.S. PATENT DOCUMENTS

| | | | |
|---|---|---|---|
| 3,721,556 | 3/1973 | Fix | 430/213 |
| 3,836,365 | 9/1974 | Reid | 430/213 |
| 3,930,864 | 1/1976 | Abel et al. | 430/941 |
| 4,131,469 | 12/1978 | Miyazako et al. | 430/213 |
| 4,379,828 | 4/1983 | Liebe et al. | 430/213 |
| 4,463,080 | 7/1984 | Snow et al. | 430/213 |
| 4,596,756 | 6/1986 | Yamanouchi et al. | 430/213 |

*Primary Examiner*—Richard L. Schilling
*Attorney, Agent, or Firm*—Sughrue, Mion, Zinn, Macpeak, and Seas

[57] ABSTRACT

A color photographic light-sensitive material is described, having on a support silver halide emulsion layers associated with a yellow dye-providing compound, a magenta dye-providing compound, and a cyan dye-providing compound, and having thereon the same support or having a different support an image-receiving layer, said image-receiving layer comprising (1) a first image-receiving layer containing at least one kind of a cyclic quaternary ammonium mordant (I) having a quaternary ammonium salt moiety of a saturated cyclic amine or pyridine as a recurring unit for preferentially mordanting a cyan dye released or formed from said cyan dye-providing compound as a result of development and (2) a second image-receiving layer containing at least one kind of a quaternary ammonium mordant (II) having a quaternary ammonium salt moiety of an acyclic amine as a recurring unit for selectively mordanting a magenta dye and a yellow dye released or formed from said magenta dye-providing compound and said yellow dye-providing compound, respectively, as a result of development.

20 Claims, No Drawings

COLOR PHOTOGRAPHIC LIGHT-SENSITIVE MATERIAL

FIELD OF THE INVENTION

This invention relates to color photographic light-sensitive materials, and more particularly to a color diffusion transfer photographic light-sensitive materials and heat-developable color photographic light-sensitive materials showing improved image quality and image preservability.

BACKGROUND OF THE INVENTION

Color diffusion transfer photographic light-sensitive materials are practically used as so-called instant color photographic films and the image-forming processes and materials or elements for the photographic films are described, for example, in *Kagaku* (Chemistry), Vol. 39, No. 5, pp. 327–331 (1984) (published by Kagaku Dojin Sha); *Photographic Science and Engineering,* Vol. 20, No. 4, July/August, pp. 155–160 (1976); Jone M. Sturge, *Neblette's Handbook of Photography and Reprography,* 7th Edition, Chapter 12, pp. 259–330 (1977), (published by Van Nostrand Reinhold Company); etc.

Also, a heat-developable color photographic light-sensitive material is known, for example, by European Patent Application (Unexamined publication) EP No. 76,492A2, etc.

In regard to color diffusion transfer photographic light-sensitive materials and heat-developable color photographic light-sensitive materials, there are many common materials used, such as dye-providing compounds, mordants, etc., and hence hereinafter, the description of the present invention with respect to a color diffusion transfer material is also applicable with respect to heat-developable color photographic light-sensitive materials.

Since the dye images obtained by conventional color diffusion transfer processes still leave room for improvement in sharpness (resolving power) and light fastness (light fading prevention), various improvements have been attempted, but sufficiently desirable improvements have not yet been obtained.

That is, it has hitherto been investigated to use light-fading preventing agents for improving light fastness of the dye images and also it has been attempted to improve the mordants and dye-providing compounds for these photographic light-sensitive materials.

For example, the light fastness is improved by the use of a light-fading preventing agent together with a mordant having a quarternary ammonium salt moiety as a recurring unit as described in Japanese Patent Application (OPI) No. 202,539/82 or the use of the mordant having a quarternary ammonium salt moiety as a recurring unit as described in Japanese Patent Application (OPI) Nos. 131,931/84, 219,745/84, 232,340/84, etc. (The term "OPI" as used herein refers to a "published unexamined Japanese patent application.")

Light fastness is also improved by the use of cyan dye-providing compounds as described, for example, in Japanese Patent Application (OPI) Nos. 143,323/78, 162,545/84, 149,362/84, etc.

As described above, the improvement of light fastness has been investigated from the viewpoints of both the mordant and the dye-providing compound (dye structure) and a considerable improvement has been obtained, but a further improvement has been keenly demanded.

On the other hand, as a large factor giving influences on the resolving power (sharpness), there are also mordants and dye (providing compounds). When the mordanting power is weak, the dye-fixing faculty is low, lowering the resolving power, and, in particular, when a light-sensitive material is in an embodiment which is stored in a wet state, there is a problem that the resolving power is gradually reduced after completing images. Accordingly, the development of mordants and dyes capable of providing high quality images having high resolving power have also been as keenly demanded as the improvement of light fastness.

SUMMARY OF THE INVENTION

An object of this invention is, therefore, to provide a color photographic light-sensitive material having improved light fastness.

Other object of this invention is to provide a color photographic light-sensitive material providing images having improved resolving power.

As a result of extensive investigations, the inventors have discovered that the above-described objects can be attained by this invention as set forth hereinbelow.

That is, this invention is directed to a color photographic light-sensitive material having on a support silver halide emulsion layers respectively associated with a yellow dye-providing compound, a magenta dye-providing compound, and a cyan dye-providing compound, and having thereon the same support or having on a different support an image-receiving layer, said image-receiving layer comprising (1) a first image-receiving layer containing at least one kind of a cyclic quaternary ammonium mordant (hereinafter referred to as mordant (II)) having a quaternary ammonium salt moiety of a saturated cyclic amine or pyridine as a recurring unit for preferentially mordanting a cyan dye released or formed from said cyan dye-providing compound as a result of development and (2) a second image-receiving layer containing at least one kind of a quaternary ammonium mordant (hereinafter referred to as mordant (II)) having a quaternary ammonium salt moiety of an acyclic amine as a recurring unit for selectively mordanting a magenta dye and a yellow dye released or formed from said magenta dye-providing compound and said yellow dye-providing compound, respectively, as a result of development.

DESCRIPTION OF THE PREFERRED EMBODIMENT

The invention is explained below in more detail.

The image-receiving layer in this invention is composed of a first image-receiving layer and a second image-receiving layer as described above, and it is preferred that the first image-receiving layer is disposed at a position farther from the support carrying it than the second image-receiving layer.

By the terminology "preferentially mordanting cyan dye(s)" in this invention is meant that the mordanting proportion of a cyan dye with respect to mordant layer A is 80% or more.

Also, by the terminology "selectively mordanting magenta dye(s) and yellow dye(s)" in this invention is meant that the mordanting proportion of these dyes with respect to mordant layer A is 30% or more.

In a practical photographic light-sensitive material, it is possible to determine the selective mordanting in the manner shown in Example 2 described below.

According to this invention, the light fastness, the resolving power, and also the transfer speed are greatly improved, which has never been expected based on the conventional techniques of using each mordant individually. However, by the selective mordanting of this invention, two effects such as a "super additive property" over the performance of the individual mordant and the effect of improving both the light fastness and the resolving power, which are usually inversely related.

The cause of obtaining such effects have not yet been clarified, but it is considered that (1) a combination of the cyan, magenta, and yellow dye structures and two or more mordants makes the light fastness and resolving power best and (2) that in one mordant layer, for example, a cyan dye and a magenta dye are preferably not mixed.

The mordant (I) for use in this invention is preferably a homopolymer or copolymer having a recurring unit represented by formula (Ia) or (Ib);

(Ia)

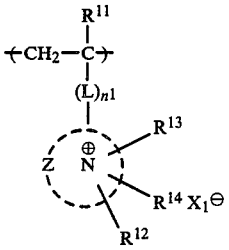

In formula (Ia), $R^{11}$ represents a hydrogen atom or an alkyl group (preferably having from 1 to 6 carbon atoms); $R^{12}$ represents an alkyl group (including a secondary or primary branched alkyl group or an alicyclic alkyl group; hereinafter the same), a substituted alkyl group, or an aralkyl group (preferably having from 7 to 20 carbon atoms), said group being a group bonded to the quaternary nitrogen atom of a saturated cyclic amine or pyridine; $R^{13}$ and $R^{14}$ (which may be the same or different) each represents a hydrogen atom, a halogen atom, an alkyl group, a substituted alkyl group, an aralkyl group, or an aryl group; L represents a divalent linking group; $n^1$ represents 0 or 1; z represents an atomic a group forming a quaternary ammonium ion of a saturated cyclic amine or pyridine; and $X_1\ominus$ represents an acid group forming a salt together with a quaternary ammonium ion. $R^{12}$ is preferably bonded directly to the nitrogen atom on the ring, and $R^{13}$ and $R^{14}$ can be bonded to the ring at any position.

Examples of the alkyl group represented by $R^{12}$, $R^{13}$, $R^{14}$ include alkyl groups having from 1 to 20 carbon atoms such as a methyl group, an ethyl group, an n-propyl group, an isopropyl group, an n-butyl group, an isobutyl group, an n-amyl group, an n-hexyl group, an n-heptyl group, an n-octyl group, a 2-ethylhexyl group, an n-nonyl group, and an n-decyl group; and examples of the substituted alkyl group represented by $R^{12}$, $R^{13}$, and $R^{14}$ are an alkoxyalkyl group (e.g., a methoxymethyl group, a methoxyethyl group, a methoxybutyl group, an ethoxyethyl group, an ethoxypropyl group, an ethoxybutyl group, a butoxyethyl group, a butoxypropyl group, a butoxybutyl group, a vinyloxyethyl group, etc.), a cyanoalkyl group (e.g., a 2-cyanoethyl group, a 3-cyanopropyl group, a 4-cyanobutyl group, etc.), a halogenated alkyl group (e.g., a 2-fluoroethyl group, a 2-chloroethyl group, a 3-fluoropropyl group, etc.), an alkoxycarbonylalkyl group (e.g., an ethoxycarbonylmethyl group, etc.), an alkenyl- or alkynyl-substituted alkyl group (e.g., an allyl group, a 2-butenyl group, a propargyl group, etc.), etc.

Examples of the aralkyl group represented by $R^{12}$, $R^{13}$, and $R^{14}$ include an unsubstituted aralkyl group such as a benzyl group, a phenethyl group, a diphenylmethyl group, a naphthylmethyl group, etc., a substituted aralkyl group such as an alkylaralkyl group (e.g., a 4-methylbenzyl group, a 2,5-dimethylbenzyl group, a 4-isopropylbenzyl group, etc.), an alkoxyaralkyl group (e.g., a 4-methoxybenzyl group, a 4-ethoxybenzyl group, a 4-(4-methoxyphenyl)benzyl group, etc.), a cyanoaralkyl group (e.g., a 4-cyanbenzyl group, a 4-(4-cyanophenyl)-benzyl group, etc.), a perfluoroalkoxyaralkyl group (e.g., a 4-pentafluoropropoxybenzyl group, a 4-undecafluorohexyloxybenzyl group, etc.), a halogenated aralkyl group (e.g., a 4-chlorobenzyl group, a 4-bromobenzyl group, a 3-chlorobenzyl group, a 4-(4-chlorophenyl)benzyl group, a 4-(4-bromophenyl)benzyl group, etc.), etc.

L preferably represents a divalent group having from 1 to about 12 carbon atoms, and of these groups, a divalent group represented by

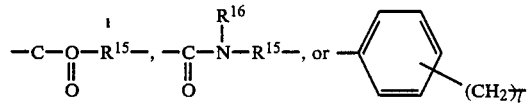

wherein l is 1 or 2) is preferred. A divalent group represented by

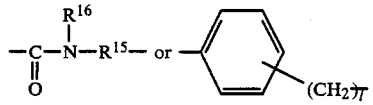

is especially preferred from the viewpoints of alkali resistance. More particularly, the divalent group represented by

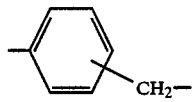

is desirable from the viewpoints of emulsion polymerizability and mordanting property.

$R^{15}$ above represents an alkylene group (e.g., a melthylene group, an ethylene group, a trimethylene group, a tetramethylene group, etc.), an arylene group, or an aralkylene group represented by

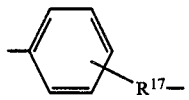

wherein, $R^{17}$ represents an alkylene group having from 1 to about 6 carbon atoms); $R^{16}$ represents a hydrogen atom or the groups described above for $R^{12}$.

The quaternary ammonium ion of a saturated cyclic amine formed by Z in formula (Ia) described above is preferably a quaternary ammonium ion of a 5- to 8-membered nitrogen-containing heterocyclic ring (especially 5- or 6-membered heterocyclic ring) and the heterocyclic atom may be a nitrogen atom as well as an oxygen atom or a sulfur atom. Specific examples thereof include quaternary ammonium ions of piperidine, pyrrolidine, and morpholine.

Specific examples of the acid group represented by $X_1\ominus$ include a halogen ion, an alkylsulfuric acid ion, an alkyl- or arylsulfonic acid ion, an acetic acid ion, a sulfuric acid ion, and, particularly preferably, a chlorine ion.

Specific examples of copolymer having the recurring unit represented by formula (Ia) described above include those represented by formulae (Iaa) and (Iab).

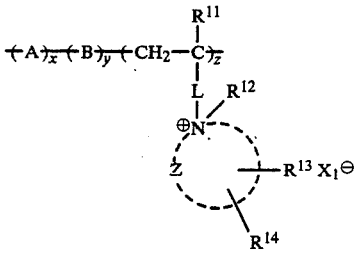

(Iaa)

In formula (Iaa), A represents a crosslinking monomer; B represents a copolymerizable ethylenically unsaturated monomer; $R^{11}$, L, $R^{12}$, $R^{13}$, $R^{14}$, and $X_1\ominus$ are the same as defined for formula (Ia); Z represents an atomic group forming a quaternary ammonium ion of a saturated cyclic amine or pyridine; x represents from 0.2 to 15 mole%, y represents from 0 to 90 mole%; and z represents from 5 to 99 mole%.

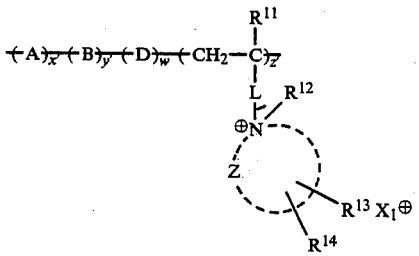

(Iab)

In formula (Iab), A, B, $R^{11}$, L, $R^{12}$, $R^{13}$, $R^{14}$, Z, and $X_1\ominus$ are the same as defined for formula (Iaa) above; D represents an acrylonitrile or a derivative thereof represented by formula (III)

$$CH_2{=}C(R^{18})\text{-}(L_1)_{m1}\text{-}CN \qquad \text{(III)}$$

wherein $R^{18}$ represents a hydrogen atom or an alkyl group, $L_1$ represents an alkylene group or an arylene group, and $m^1$ represents 0 or 1; x' represents from 0 to 10 mole%; y' represents from 0 to 80 mole%; w represents from 5 to 90 mole%; and z' represents from 10 to 90 mole%.

The crosslinking monomer residue represented by A in formulae (Iaa) and (Iab) is a monomer unit derived from a monomer having the structure represented by formula (IV)

$$(CH_2{=}C(R^{19}))_{m2}\text{-}Q \qquad \text{(IV)}$$

wherein $m^2$ represents an integer of greater than 1, preferably 2 or 3; $R^{19}$ represents a hydrogen atom or a methyl group; and Q represents a linking group (such as an amido group (e.g., a sulfonamido group, etc.), an ester group (e.g., a sulfonic acid ester group, etc.), an alkylene group (e.g., a methylene group, an ethylene group, a trimethylene group, etc.), an arylene group (e.g., a phenylene group, a phenyleneoxycarbonyl group, etc.), or a combination of these groups).

Examples of the above-described copolymerizable monomer are trivinylcyclohexane, divinylbenzene, ethylene glycol dimethacrylate, propylene glycol dimethacrylate, neopentyl glycol dimethacrylate, tetramethylene glycol dimethacrylate, tetramethylene glycol dimethacrylate, etc., and in these monomers, trivinylcyclohexane and divinylbenzene are particularly preferred.

The copolymerizable ethylenically unsaturated monomer residue represented by B in formulae (Iaa) and (Iab) is a group derived from an ethylenically unsaturated monomer and examples of the ethylenically unsaturated monomer are olefins (e.g., ethylene, propylene, 1-butene, vinyl chloride, vinylidene chloride, isobutene, vinyl bromide, etc.), dienes (e.g., butadiene, isopresene, chloroprene, etc.), ethylenically unsaturated esters of fatty acids or aromatic carboxylic acids (e.g., vinyl acetate, allyl acetate, vinyl propionate, vinyl butyrate, vinyl benzoate, etc.), esters of ethylenically unsaturated acids (e.g., methyl methacrylate, n-butyl methacrylate, tert-butyl methacrylate, n-hexyl methacrylate, cyclohexyl methacrylate, benzyl methacrylate, phenyl methacrylate, octyl methacrylate, ethyl acrylate, n-butyl acrylate, n-octyl acrylate, amyl acrylate, 2-ethylhexyl acrylate, benzyl acrylate, dibutyl maleate, diethyl fumarate, ethyl crotonate, methylenemalonic acid dibutyl ester, etc.), and styrenes (e.g., styrene, α-methylstyrene, vinyltoluene, chloromethylstyrene, chlorostyrene, dichlorostyrene, bromostyrene, etc.). In these monomers, styrenes and methacrylic acid esters are particularly preferred from the viewpoints of emulsion polymerizability, hydrophobic property, etc. In addition, B may include two or more of the above-described monomers.

Next, moiety D in formula (Iab) is further explained. $R^{18}$ of formula (III) is a hydrogen atom or a lower alkyl group preferably having from 1 to about 6 carbon atoms (e.g., a methyl group, an ethyl group, an n-propyl group, an n-butyl group, an n-amyl group, an n-hexyl group, etc.) and is particularly preferably a hydrogen atom or a methyl group. $L_1$ in formula (III) represents an alkylene group, preferably having from 1 to about 6 carbon atoms (e.g., a methylene group, an ethylene group, an isopropylene group, a hexylene group, etc.) or an arylene group preferably having from 6 to about 10 carbon atoms (e.g., a phenylene group, etc.).

Specific examples of acrylonitrile and the derivatives thereof are acrylonitrile, methacrylonitrile, acryl cyanamide, and crotononitrile. The copolymer represented by formula (Iab) may contain two or more moieties represented by D.

About the values of x, y, and z, or x', y', and z' which are the ratios of the monomer components or moieties in formula (Iaa) or (Iab) described above, it is preferred that x or x' is from 1.0 to 10 mole%, y or y' is from 20 to 60 mole%, and z or z' is from 20 to 80 mole%, and more preferably from 30 to 70 mole%.

Specific examples of the polymer mordants represented by formulae (Iaa) and (Iab) as described above are set forth below.

Ia-1

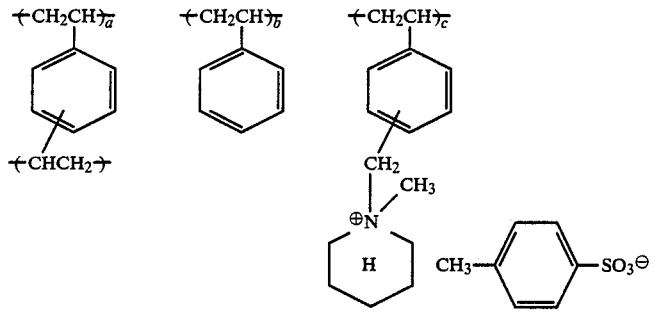

a/b/c = 5/47.5/47.5

Ia-2

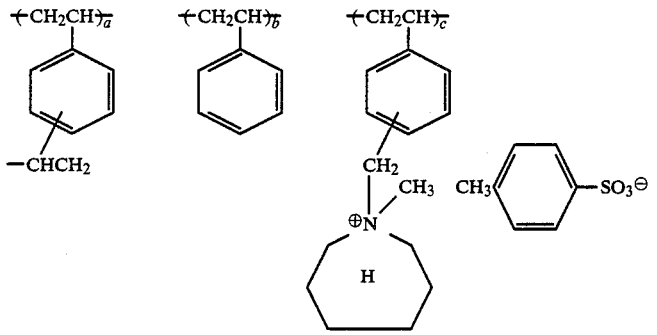

a/b/c = 5/47.5/47.5

Ia-3

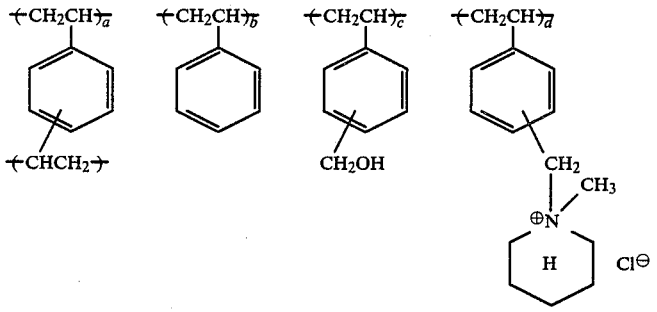

a/b/c/d = 5/47.5/5.5/42

Ia-4

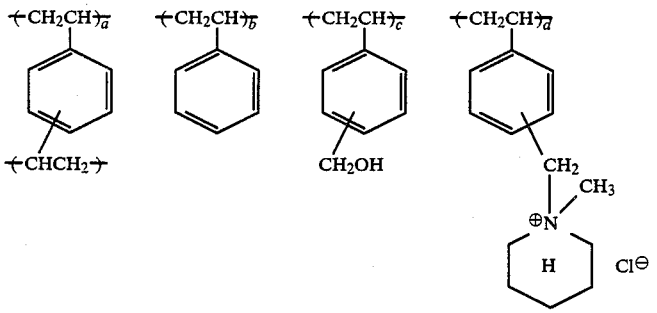

a/b/c/d = 5/35/8/52

-continued
Ia-5
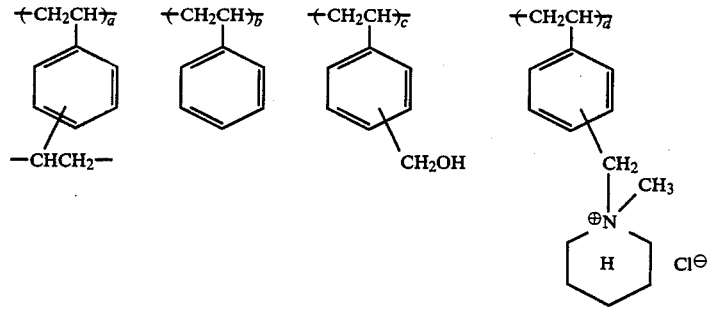
a/b/c/d = 5/25/10/60
Ia-6
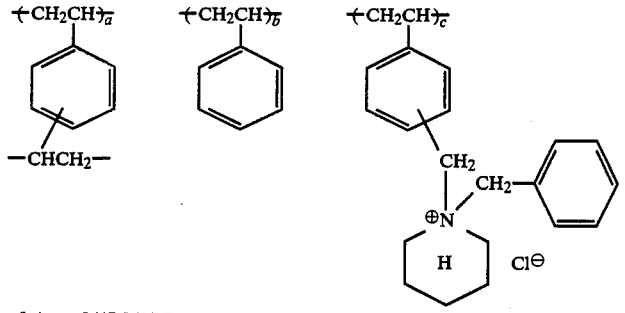
a/b/c = 5/47.5/47.5
Ia-7
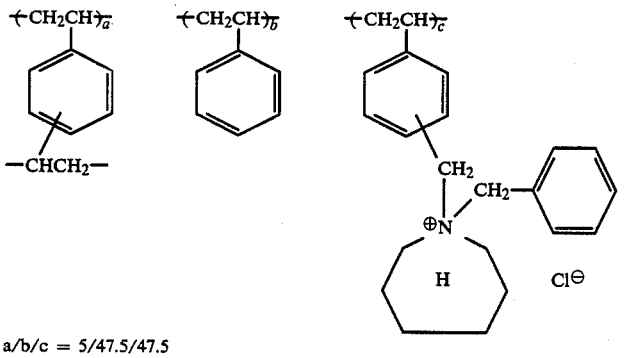
a/b/c = 5/47.5/47.5
Ia-8
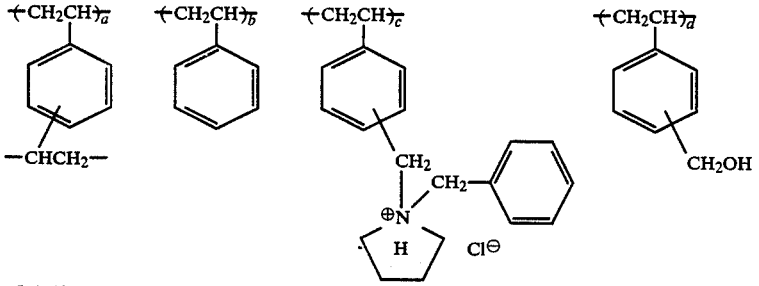
a/b/c/d = 5/35/52/8
Ia-9
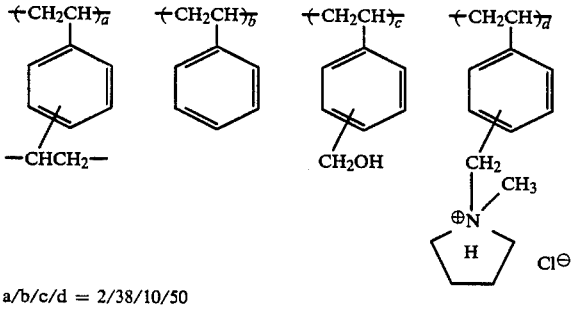
a/b/c/d = 2/38/10/50

-continued
Ia-10
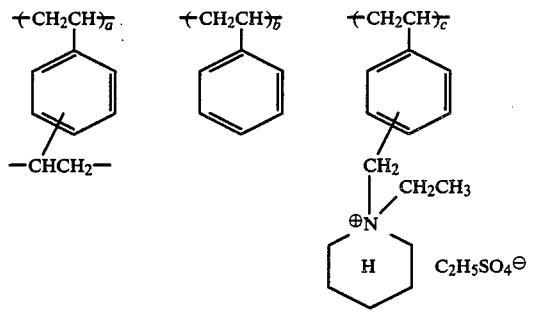
a/b/c = 1/49/50
Ia-11
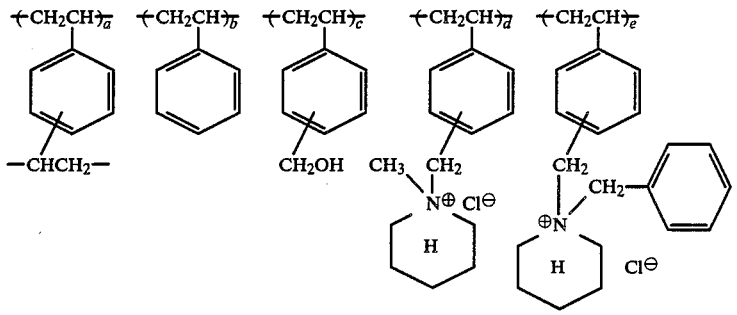
a/b/c/d/e = 5/47/5/30/13
Ia-12
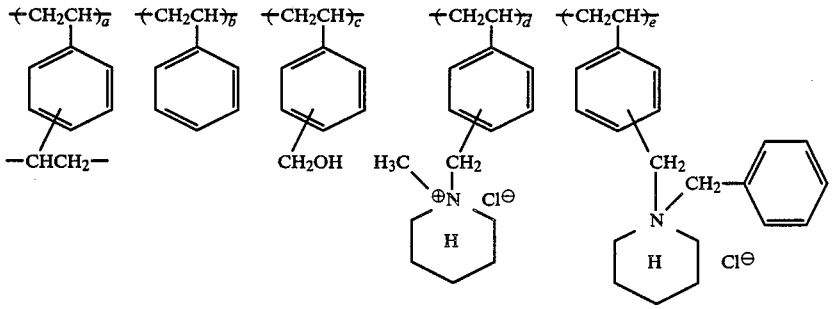
a/b/c/d/e = 5/47/5/13/30
Ia-13
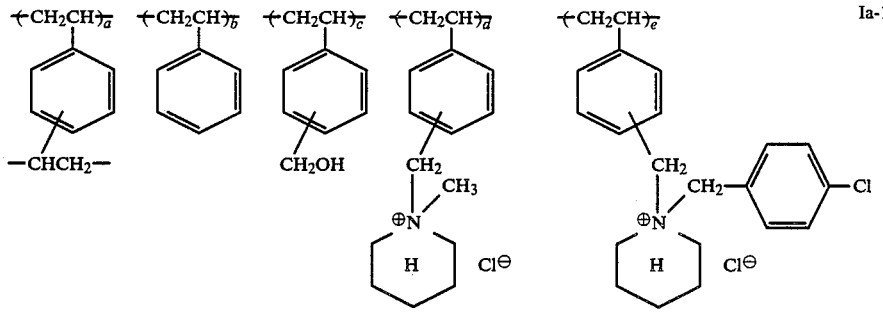
a/b/c/d/e = 2/20/8/35/35

-continued
Ia-14
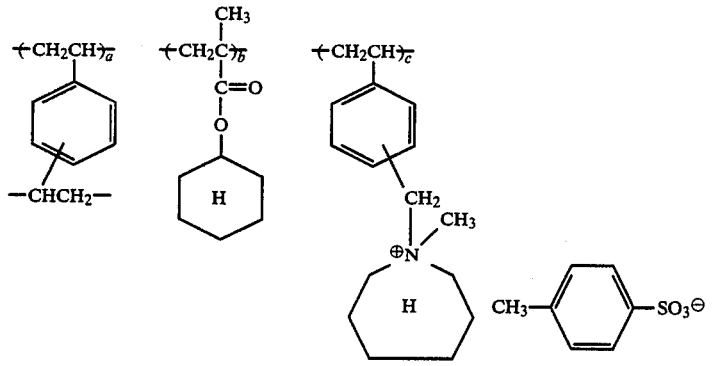
a/b/c = 2/63/35
Ia-15
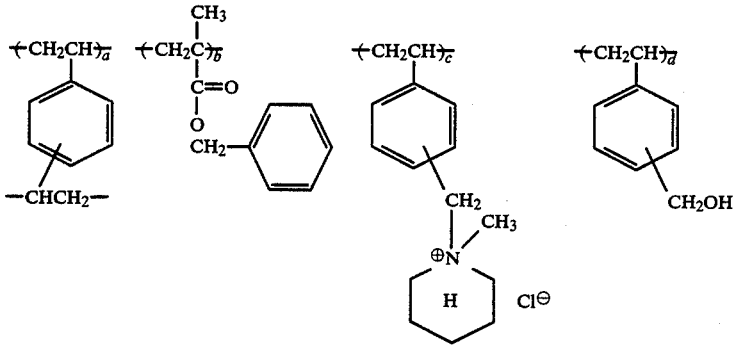
a/b/c/d = 4/52/38/6
Ia-16
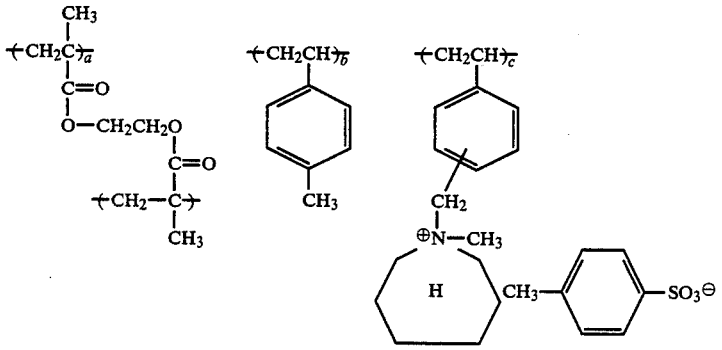
a/b/c = 3/57/40
Ia-17
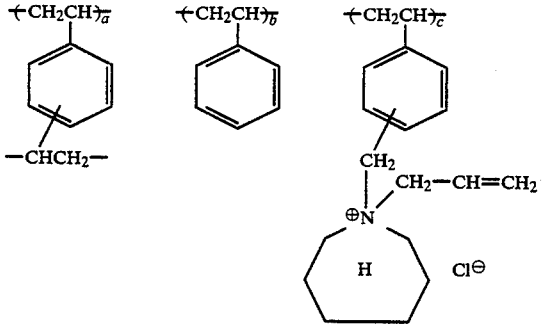
a/b/c = 4/60/36

-continued
Ia-18
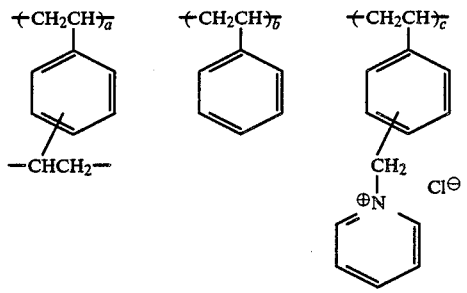
a/b/c = 2/38/60
Ia-19
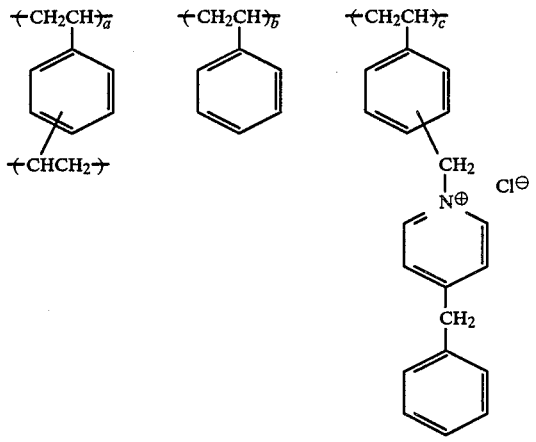
a/b/c = 1/52/47
Ia-20
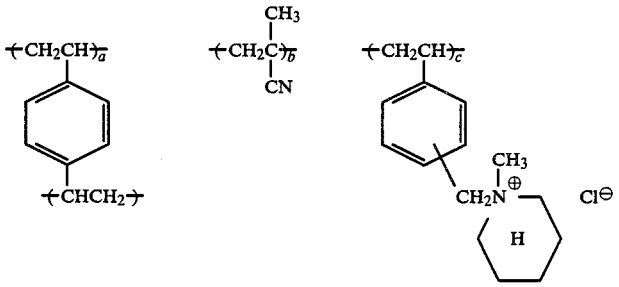
a/b/c = 5/47.5/47.5
Ia-21
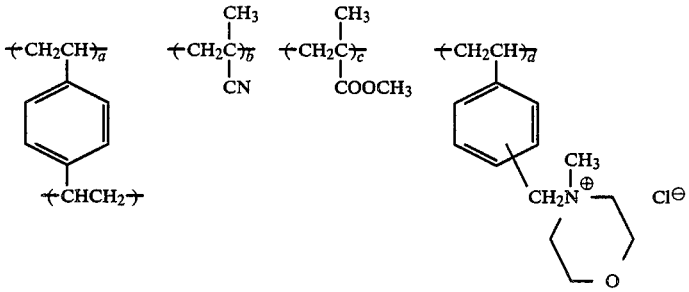
a/b/c/d = 5/60/10/25

-continued
Ia-22
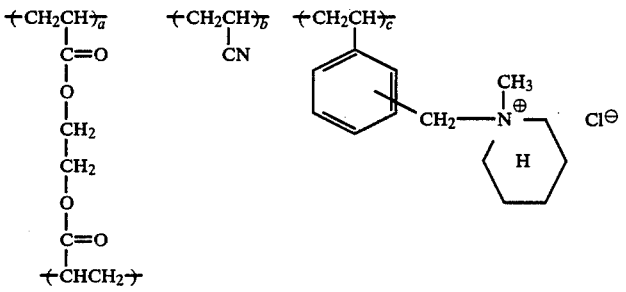
a/b/c = 5/65/30
Ia-23
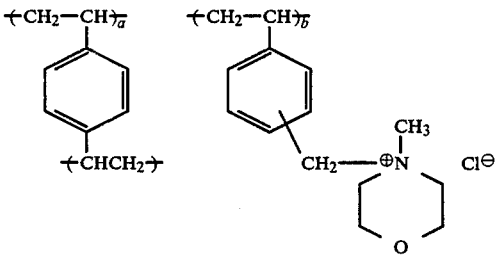
a/b = 5/95
Ia-24
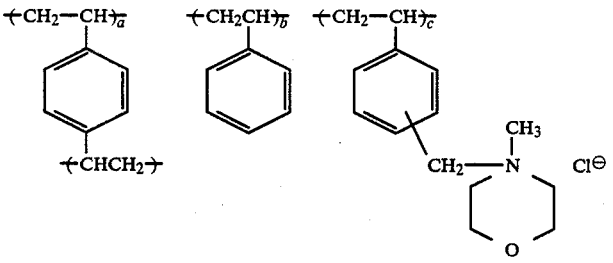
a/b/c = 5/30/65
Ia-25
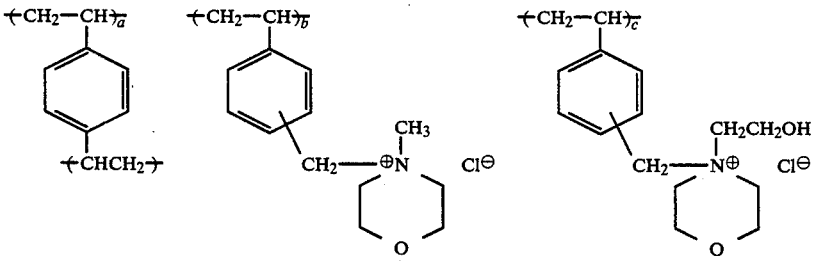
a/b/c = 5/47.5/47.5
Ia-26
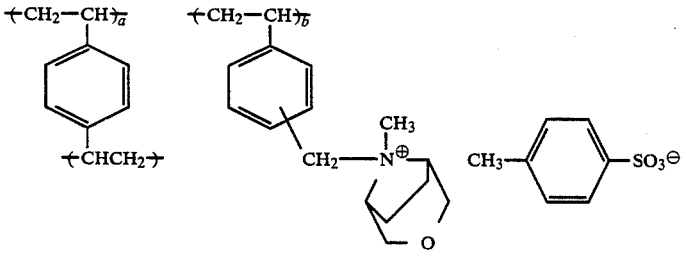
a/b = 5/95

-continued

Ia-27

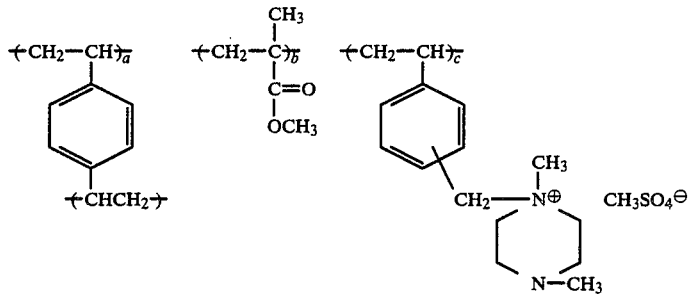

a/b/c = 5/30/65

Ia-28

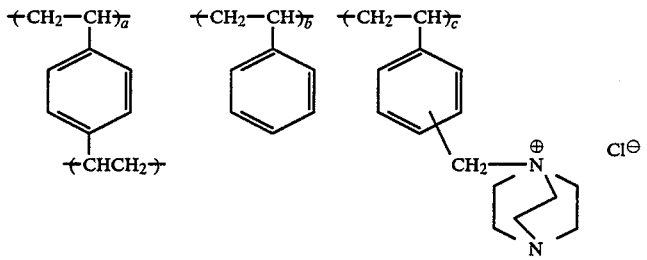

a/b/c = 5/25/70

Ia-29

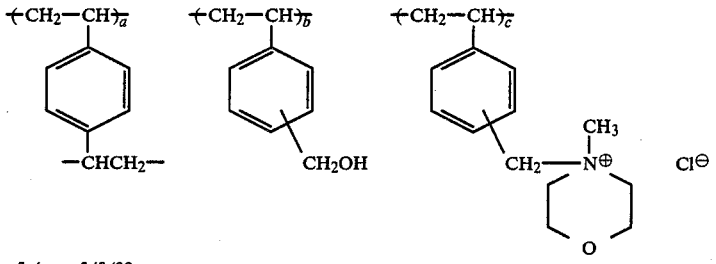

a/b/c = 5/5/90

Specific examples of the synthesis processes for the polymer mordants represented by formulae (Iaa) and (Iab) are described in Japanese Patent Application (OPI) Nos. 202,539/82, 219,745/84, and 232,340/84.

Next, homopolymers or copolymers having a recurring unit represented by formula (Ib) are explained.

(Ib)

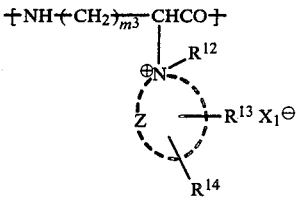

In formula (Ib), $R^{12}$, $R^{13}$, $R^{14}$, $X_1\ominus$, and Z are the same as defined in formula (Iaa) and $m^3$ represents an integer of 1 to 10.

Specific examples of the aforesaid polymer mordants having the recurring unit represented by formula (Ib) are illustrated below.

Ib-1:

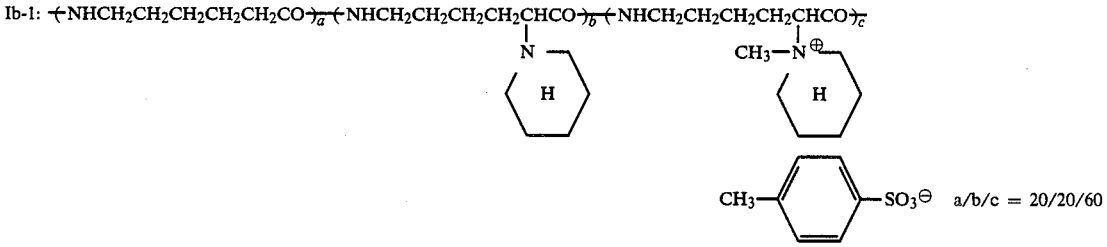

a/b/c = 20/20/60

-continued

Ib-2: 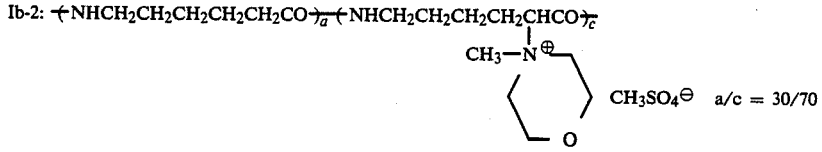

a/c = 30/70

Ib-3: 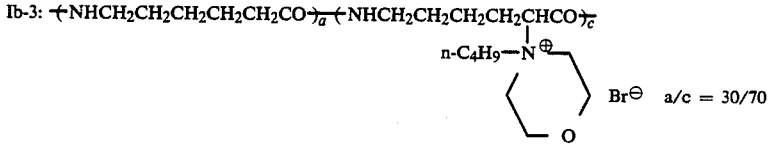

a/c = 30/70

The polymer mordants having the recurring unit represented by formula (Ib) described above are described in Japanese Patent Application (OPI) No. 131,931/84.

Other specific examples of the cyclic quaternary ammonium mordants which can be used are the compounds described. For example, in U.S. Pat. Nos. 4,239,847, 4,452,878, and 4,424,272, West German Patent Application (OLS) 3,109,931Al, etc.

The mordants (II) for use in this invention are homopolymers or copolymers having a recurring unit represented by formula (IIa) or (IIb)

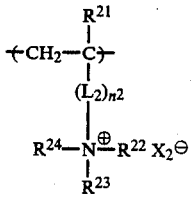

(IIa)

In formula (IIa), $R^{21}$ has the same meaning as $R^{11}$ in formula (Ia) described above; $L_2$, $n^2$ and $X_2\ominus$ have the same meaning as L, $n^1$, and $X_1\ominus$, respectively, in formula (Ia) described above, and $R^{22}$, $R^{23}$, and $R^{24}$, (which may be the same or different) each has the same meaning as $R^{12}$ in formula (Ia).

Examples of the copolymers having the recurring unit represented by formula (IIa) described above are those represented by formulae (IIaa) and (IIab).

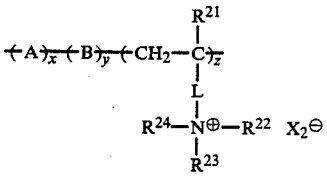

(IIaa)

In formula (IIaa), the symbols A, B, L, etc., have the same meaning as in formulae (Iaa) and (IIa) described above.

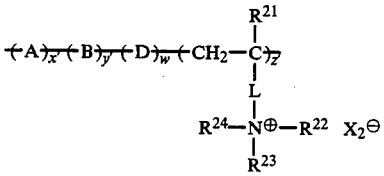

(IIab)

In formula (IIab), the symbols A, B, L, etc. have the same meanings as in formulae (Iab) and (IIa) described above.

Specific examples of the polymer mordants represented by formulae (IIaa) and (IIab) described above are illustrated below.

IIa-1

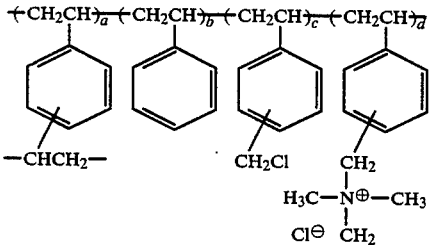

a/b/c/d = 2/49/4.9/44.1

IIa-2

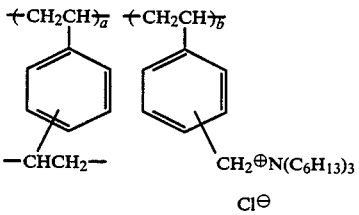

a/b = 5/95

-continued
IIa-3
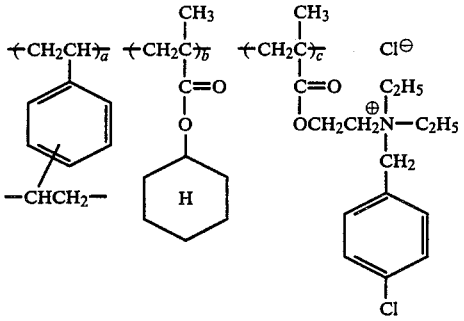
1/b/c = 4/48/48
IIa-4
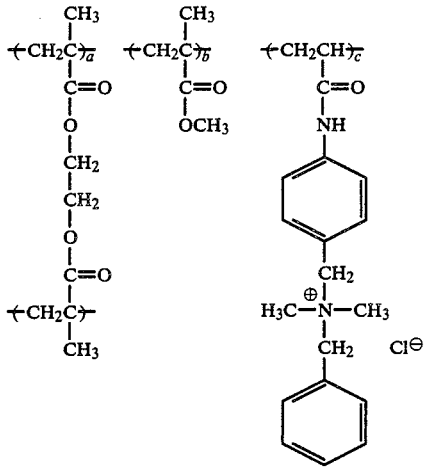
a/b/c = 4/60/36
IIa-5
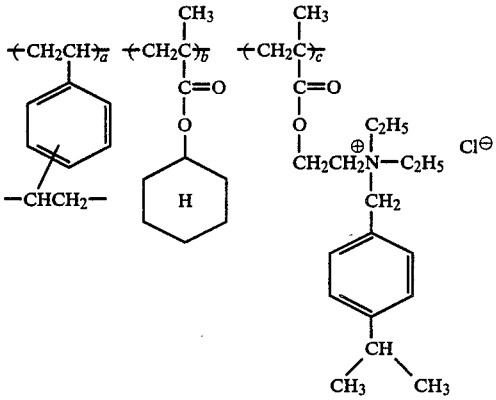
a/b/c = 4/48/48
IIa-6
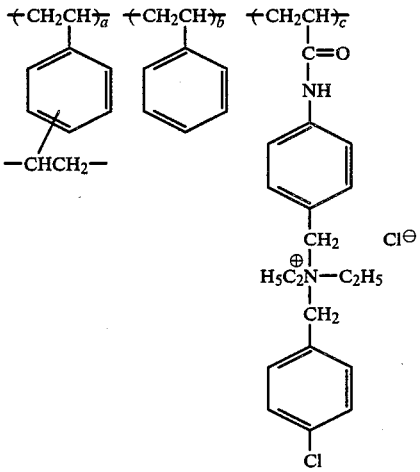
a/b/c = 2/49/49
IIa-7
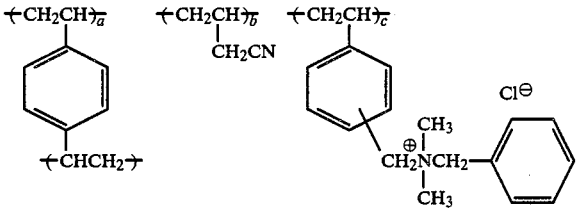
a/b/c = 5/65/30
IIa-8
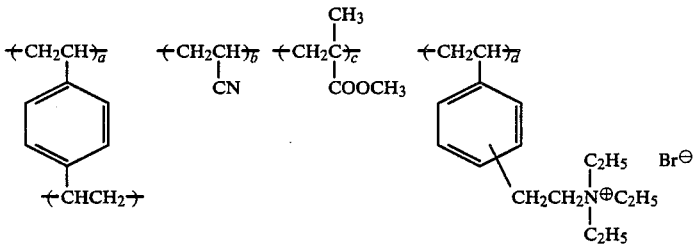
a/b/c/d = 5/50/5/40
IIa-9
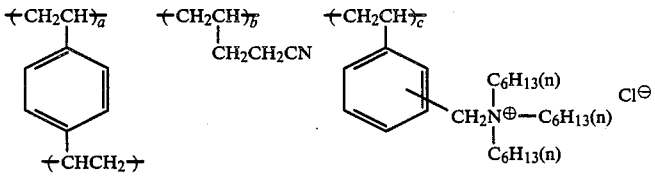

-continued a/b/c = 5/47.5/47.5

Homopolymers or copolymers having the recurring unit represented by formula (IIb) are next explained.

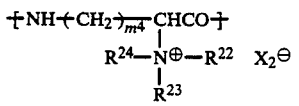

(IIb)

In formula (IIb), $m^4$ has the same meaning as $m^3$ in formula (Ib) and other symbols have the same meanings as in formula (IIa) described above.

Specific examples of the mordants having recurring unit represented by formula (IIb) are set forth below.

IIb-1:

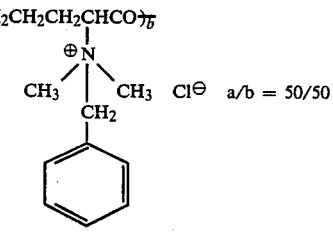

a/b = 50/50

IIb-2:

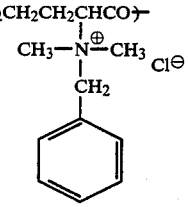

IIb-3:

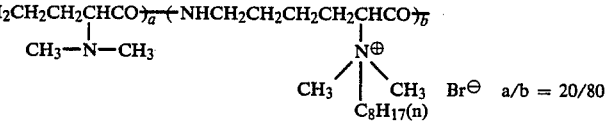

a/b = 20/80

IIb-4:

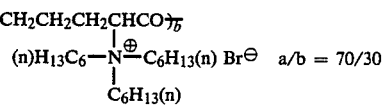

a/b = 70/30

IIb-5:

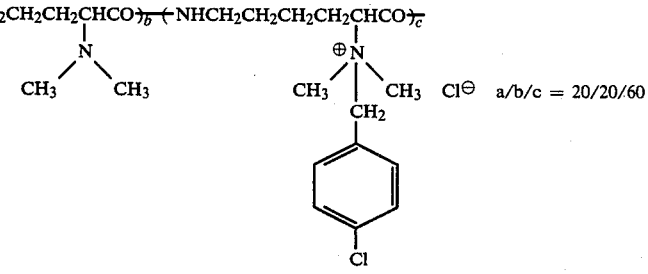

a/b/c = 20/20/60

IIb-6:

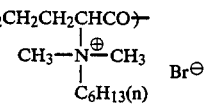

IIb-7:

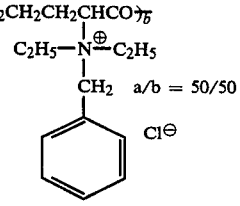

a/b = 50/50

-continued

IIb-8: 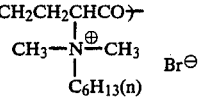

IIb-9 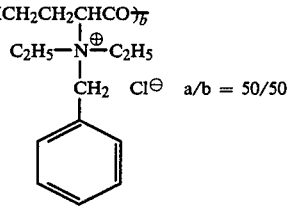

Details of the synthesis methods for the mordants represented by the above-described formulae (IIaa) and (IIab) are described in Japanese Patent Application (OPI) Nos. 202,539/82 and 219,745/84. Also, the polymer mordants having the recurring unit represented by formula (IIa) are described in the aforesaid Japanese Patent Application (OPI) No. 131,931/84.

Other specific examples of mordant (II) are described, for example, in Japanese Patent Application (OPI) Nos. 23,851/85, 23,852/85, and 28,650/85, U.S. Pat. Nos. 4,288,511, 4,340,522, 4,322,489, 4,463,080, 4,424,272, and 4,424,326, British Patent Publication (Unexamined) No. 2,075,034A, German Patent Application (OLS) No. 3,109,931Al, etc.

The first image-receiving layer and the second image-receiving layer in this invention may be formed by the mordant (I) and the mordant (II) alone, respectively but they may also contain a natural or synthetic hydrophilic polymer which is generally used for photographic field, such as gelatin, polyvinyl alcohol, polyvinylpyrrolidone, etc., and preferably polyvinyl alcohol.

The addition amounts of mordant (I) and mordant (II) is generally from about 20 to 80% by weight, and preferably from about 40 to 60% by weight based on the weight of the respective image-receiving layer in which each is incorporated, and the coverage is generally from about 0.5 to 8 g/m$^2$, and preferably from about 1 to 5 g/m$^2$.

The dye-providing compounds which are used associated with the silver halide emulsion layers in this invention can be of negative working type or positive working types, and are initially mobile or immobile compounds in a photographic element when processed with an alkaline processing composition.

An example of a negative working type image-providing compound useful for the invention is a coupler which forms or releases a dye upon reaction with an oxidation product of a color developing agent, and specific examples thereof are described in U.S. Pat. No. 3,227,550, Canadian Pat. No. 602,607, etc. A preferred negative working type dye-providing compound for use in this invention is a dye-releasing redox compound which releases a dye upon reaction with a developing agent in the oxidized state or an electron transferring agent. Specific examples thereof are described in U.S. Pat. Nos. 3,928,312, 4,135,929, 4,055,428, and 4,336,322, etc.

An example of a mobile positive working type dye-providing compound which can be used in this invention is a compound releasing a diffusible dye without receiving an electron (i.e., without being reduced) or after receiving at least one electron (i.e., after being reduced) during photographic processing under an alkaline condition. Specific examples of these compound are described in U.S. Pat. Nos. 4,199,354, 3,980,479, 4,199,355, 4,139,379, 4,139,389, and 4,232,107, and Japanese Patent Application (OPI) No. 69,033/78.

Furthermore, a positive working type dye-providing compound which is mobile under an alkaline photographic processing condition from the first stage is also useful in this invention. Specific examples of the compound are dye developing agents and such are described in U.S. Pat. Nos. 3,482,972 and 3,880,658, etc.

The dye formed from the dye-providing compound for use in this invention may be a dye itself or a dye precursor capable of being converted into a dye in a photographic processing step or an additional processing step and further the dye of the final image may or may not be in the form of complex salt. Specific dyes useful in this invention are azo dyes, azomethine dyes, anthraquinone dyes, and phthalocyanine dyes, which may or may not be in the form of the metal complex salt thereof.

In these dyes, the cyan, magenta, and yellow azo dyes are particularly useful.

Examples of the yellow dye-providing compounds are described in U.S. Pat. Nos. 3,597,200, 3,309,199, 4,013,633, 4,245,028, 4,156,609, 4,139,383, 4,195,992, 4,148,641, and 4,148,643, Japanese Patent Application (OPI) Nos. 114,930/76, 16,130/81, and 71,072/81, *Research Disclosure,* RD No. 17630 (1978), ibid, RD No. 16475 (1977), etc.

Specific examples of the magenta dye-providing compound(s) for use in this invention are described in U.S. Pat. Nos. 3,453,107, 3,544,545, 3,932,380, 3,931,144, 3,932,308, 3,954,476, 4,233,237, 4,255,509, 4,250,246, 4,142,891, 4,207,104, and 4,287,292, Japanese Patent Application (OPI) Nos. 106,727/77, 23,628/78, 36,804/80, 73,057/81, 71,060/81, and 134/80, etc.

Specific examples of the cyan dye-providing compounds for use in this invention are described in U.S. Pat. Nos. 3,482,972, 3,929,760, 4,013,635, 4,268,625, 4,171,220, 4,242,435, 4,142,891, 4,195,994, 4,147,544, and 4,148,642, British Pat. No. 1,551,138, Japanese Patent Application (OPI) Nos. 99,431/79, 8,827/77, 47,823/78, 143,323/78, 99,431/79, 71,061/81, 162,545/84, and 149,362/84, European Pat. Nos. 53,037 and 52,040, *Research Disclosure,* RD Nos. 17630 (1978) and 16475 (1977), etc.

Also, a dye-releasing redox compound having a dye moiety wherein the optical absorption is temporarily shifted in a light-sensitive element can be used as a kind of dye precursor in this invention. Specific examples of such a compound are described in U.S. Pat. No. 4,310,612, Ser. No. T999,003, U.S. Pat. Nos. 3,336,287, 3,579,334, and 3,982,946, British Pat. No. 1,467,317, Japanese Patent Application (OPI) No. 158,638/82, etc.

A silver halide developing agent which can cross-oxidize the dye-releasing redox compound can be used in this invention. Such a developing agent may be incorporated in an alkaline processing composition or a proper layer of a photographic element, e.g., a silver halide emulsion layer, a dye-providing compound-containing layer, and a color mixing preventing layer.

Examples of the developing agent which can be used in this invention are the hydroquinones, aminophenols, phenylenediamines, and pyrazolidinones (e.g., phenidone, 1-phenyl-3-pyrazolidinone, dimezone (i.e., 1-phenyl-4,4-dimethyl-3-pyrazolidinone), 1-p-tolyl-4-methyl-4-oxymethyl-3-pyrazolidinone, 1-phenyl-4-methyl-4-oxymethyl-3-pyrazolidinone, etc.), etc.

In these developing agents, black-and-white developing agents (particularly, pyrazolidinones) having a property of reducing the formation of stain in an image-receiving layer are more preferred than a color developing agent such as a phenylenediamine.

It is preferred that the processing composition for processing the photographic light-sensitive material of this invention contains a base such as sodium hydroxide, potassium hydroxide, sodium carbonate, sodium phosphate, etc., and has a pH of about 9 or higher, and preferably about 11.5 or higher.

The photographic light-sensitive material of this invention can be also used for photographic processes other than the color diffusion transfer process specifically described above.

When the photographic light-sensitive material of this invention is a so-called photographic film unit, that is, a film unit which can be processed by passing through a pair of juxtaposed pressure-applying members, it is typically composed of the following elements:

(1) A light-sensitive element;

(2) An image-receiving element having a first image-receiving layer and a second image-receiving layer according to this invention;

(3) A rupturable container including a means for releasing an alkaline processing composition and containing a silver halide developing agent in the inside of the film unit; and (4) At least one support.

In an embodiment of this film unit, a light-sensitive element having on a support silver halide emulsion layers which are respectively associated with a cyan dye-providing compound, a magenta dye-providing compound, and a yellow dye-providing compound is, after imagewise exposure, superposed on an image-receiving element having on a different support the second image-receiving layer and the first image-receiving layer with a face-to-face relationship and is processed by spreading an alkaline processing composition between both of the elements. In this case, it is preferred that when the film unit is pulled out from a camera, the light-sensitive element thereof or the film unit itself is light-shaded on both sides thereof. In this embodiment, the image-receiving element may be peeled off after transfer of the image, or the image formed in the image-receiving layer may be viewed without peeling off, as described, e.g., in U.S. Pat. No. 3,415,645.

In other embodiment of this invention, a support, an image-receiving element, and a light-sensitive element in the aforesaid fulm unit are disposed in unity. For example, on a transparent support are formed, in succession, the second image-receiving layer, the first image-receiving layer, a substantially opaque light-reflection layer (e.g., a $TiO_2$ layer and a carbon black layer), and light-sensitive layers associated with a cyan dye-providing compound, a magenta dye-providing compound, and a yellow dye-providing compound, respectively. After imagewise exposure of the light-sensitive layers of the film unit, an opaque cover sheet is superposed on the film unit with a face-to-face relationship and then an alkaline processing composition is spread therebetween.

In another embodiment of an integrated type to which this invention can be applied, on a transparent support are formed, in succession, the second image-receiving layer, the first image-receiving layer, a substantially opaque light-reflection layer (e.g., a $TiO_2$ layer and a carbon black layer), and light-sensitive layers as described above, and further a transparent cover sheet is disposed thereon with a face-to-face relationship. A rupturable container containing an alkaline processing composition containing an opacifying agent (e.g., carbon black) is disposed adjacent to the uppermost layer of the above-described light-sensitive layers and the transparent cover sheet. The film unit is imagewise exposed in a camera through the transparent cover sheet and in the case of pulling out the film unit from the camera, the container is ruptured by means of pressure-applying members to uniformly spread the processing composition (containing the opacifying agent) throughout the space between the light-sensitive layer and the cover sheet, whereby the film unit is light-shaded and the development proceeds.

Mordanting power test method (model system):

A mordant sheet, a processing liquid, and a cover sheet were prepared as follows.

Mordant sheet:

On a transparent polyethylene terephthalate support were successively coated the following layers.

(1) Mordant layer B. A layer containing mordant (II) and gelatin. The proportions thereof may be optionally changed.

(2) White reflection layer: A layer containing 20 $g/m^2$ of titanium dioxide and 2.0 $g/m^2$ of gelatin.

(3) Mordant layer A: A layer containing mordant (I) and gelatin. The proportions thereof may be optionally changed.

Processing Liquid:

| | |
|---|---|
| Potassium Hydroxide | 56 g |
| Carboxymethyl Cellulose Na Salt | 43 g |
| Dyes | x g |
| Water to make | 1 kg |

The amounts of the dyes were such that when the processing liquid containing them was spread at a thickness of 80 μm, the reflection density of each of yellow, magenta, and cyan dyes became about 1.5.

Cover Sheet:

The cover sheet was prepared by successively forming the following layers (1') to (4') on a transparent polyester support.

(1') A layer containing 22 $g/m^2$ of a copolymer of acrylic acid and butyl acrylate of 80 to 20 (by weight ratio) and 0.44 $g/m^2$ of 1,4-bis(2,3-epoxypropoxy)-butane.

(2') A layer containing 3.8 $g/m^2$ of acetyl cellulose (forming 39.4 g of acetyl group when 100 g of the acryl cellulose was hydrolyzed), 0.2 $g/m^2$ of a copolymer (having a molecular weight of about 50,000) of styrene and maleic anhydride (60/40 weight ratio), and 0.115 g/m$^2$ of 5-(β-cyanoethylthio)-1-phenyltetrazole.

(3') A layer containing 2.5 g/m$^2$ of a copolymer latex of vinylidene chloride, methyl acrylate, and acrylate acid (85/12/3 weight ratio) and 0.05 g/m$^2$ of polymethyl methacrylate latex (particle size of 1 to 3 μm).

(4') A layer containing 4 g/m$^2$ of gelatin.

The above-described mordant sheet, processing liquid, and cover sheet were combined, the processing liquid was spread at a thickness of 80 μm, and 60 minutes after spreading, they were stored for 14 days at room temperature or for 3 days at 35° C. and 80% relative humidity (RH). Thereafter, the density of mordant layer A was measured from the support side of the mordant sheet and the density of mordant layer B was measured from the cover sheet side with the white reflection layer as the boundary layer. Then, the ratio of the density of mordant layer A to the sum of both the densities was determined.

The value of 50% means that the mordanted amount of the dyes in mordant layer A is same as that in mordant layer B, the value of higher than 50% means a preferential mordanting property for mordant layer A, and the value of lower than 50% means the preferential mordanting property for mordant layer B.

The following examples are intended to illustrate this invention but not to limit it in any way.

EXAMPLE 1

The selective mordanting property was determined according to the mordanting power test method described above.

The mordants and the amounts thereof are shown in Table 1 described below.

In the Example, the cyan, magenta, and yellow dyes shown below were used.

-continued

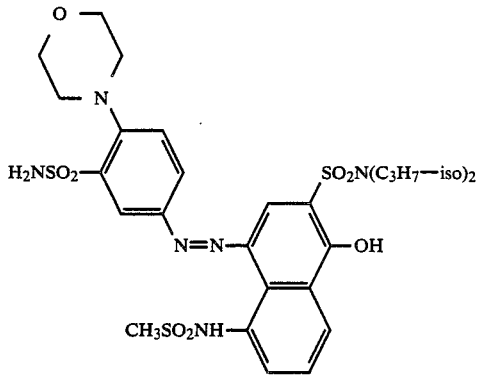

Yellow Dye

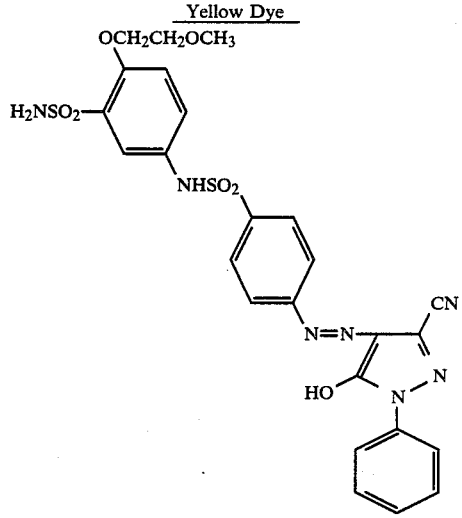

TABLE 1

| | Content of Coating (g/m$^2$) | | | | Mordanting Ratio (%) to Mordant Layer A | | | | | |
|---|---|---|---|---|---|---|---|---|---|---|
| | Mordant Layer B | | Mordant Layer B | | 14 Days, Room Temp. | | | 3 Days, 35° C., 80% RH | | |
| | Modant | Gelatin | Modant | Gelatin | Y | M | C | Y | M | C |
| a | IIa-2 1.5 | 1.5 | Ia-3 1.5 | 1.5 | 5 | 2 | 99 | 4 | 1 | 99 |
| b | IIa-2 2 | 2 | Ia-3 1 | 1 | 3 | 1 | 99 | 3 | 2 | 98 |
| c | IIa-2 1.5 | 1.5 | Ia-24 1.5 | 1.5 | 3 | 1 | 98 | 4 | 1 | 98 |

Cyan Dye

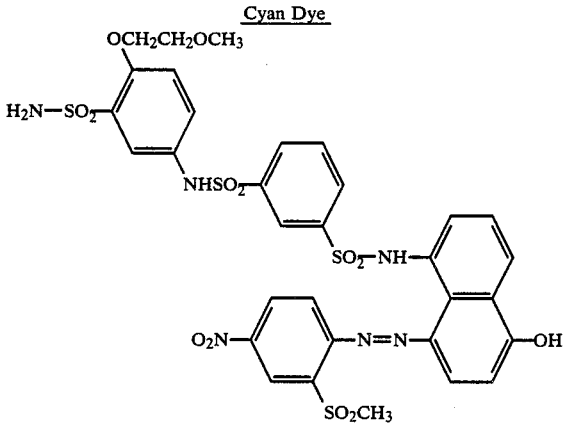

Magenta Dye

EXAMPLE 2

A model light-sensitive sheet, a cover sheet, and a processing liquid were prepared as follows and the selective mordanting property in this invention was confirmed by the practical system.

Light-Sensitive Sheet:

Each of light-sensitive sheets 1A to 5A was prepared by successively forming the following layers on a transparent polyester support.

(1) A lower mordant layer containing the mordant and gelatin shown in Table 2 below.

(2) A peel-off layer containing 0.5 g/m$^2$ of hydroxyethyl cellulose.

(3) An upper mordant layer containing the mordant had gelatin shown in Table 2 below.

(4) A light-reflection layer containing 20 g/m$^2$ of titanium dioxide and 2.0 g/m$^2$ of gelatin.

(5) A light-shading layer containing 3.0 g/m$^2$ of carbon black and 2.0 g/m$^2$ of gelatin.

(6) A layer containing 0.44 g/m$^2$ of the cyan dye-releasing redox compound having the structure shown below, 0.09 g/m$^2$ of tricyclohexyl phosphate, and 0.8 g/m$^2$ of gelatin.

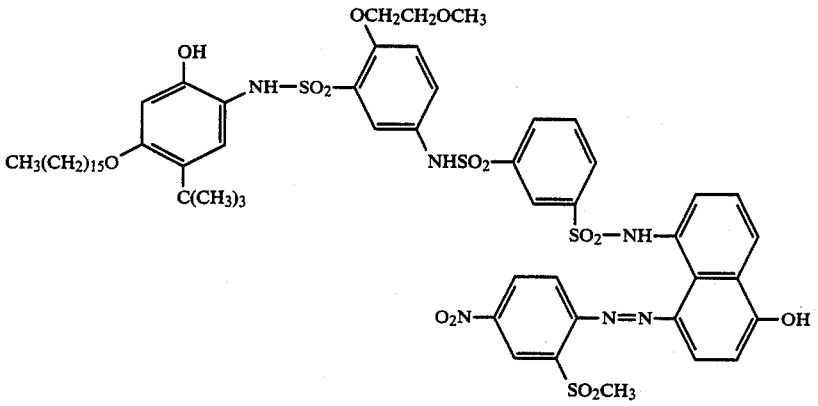

(7) A layer containing a red-sensitive internal latent image-type direct reversal silver bromide emulsion (1.03 g/m$^2$ as silver amount), 1.2 g/m$^2$ of gelatin, 0.05 mg/m$^2$ of the nucleating agent having the structure described below, and 0.13 g/m$^2$ of 2-sulfo-5-n-pentadecylhydroquinone.sodium salt.

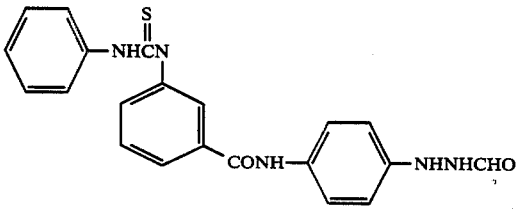

(8) A color mixing preventing layer containing 0.8 g/m$^2$ of gelatin, 1.0 g/m$^2$ of 2,5-di-t-pentadecylhydroquinone, and 1.0 g/m$^2$ of polymethyl methacrylate.

(9) A layer containing 0.40 g/m$^2$ of the magneta dye-releasing redox compound having the structure described below, 0.08 g/m$^2$ of tricyclohexyl phosphate, and 0.9 g/m$^2$ of gelatin.

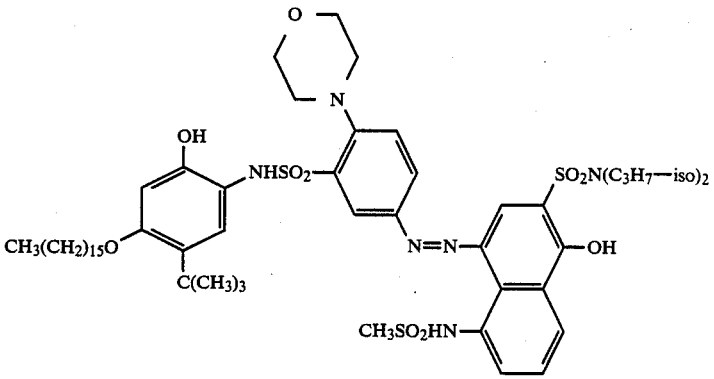

(10) A layer containing a green-sensitive internal latent image-type direct reversal silver bromide emulsion (0.82 g/m$^2$ as silver amount), 0.9 g/m$^2$ of gelatin, 0.03 mg/m$^2$ of the nucleating agent as used in Layer (7) described above, and 0.08 g/m$^2$ of 2-sulfo-5-n-pentadecylhydroquinone.sodium salt.

(11) A layer having the same composition as Layer (8) described above.

(12) A layer containing 0.53 g/m$^2$ of the yellow dye-providing redox compound having the structure described below, 0.13 g/m$^2$ of tricyclohexyl phosphate, and 0.7 g/m$^2$ of gelatin.

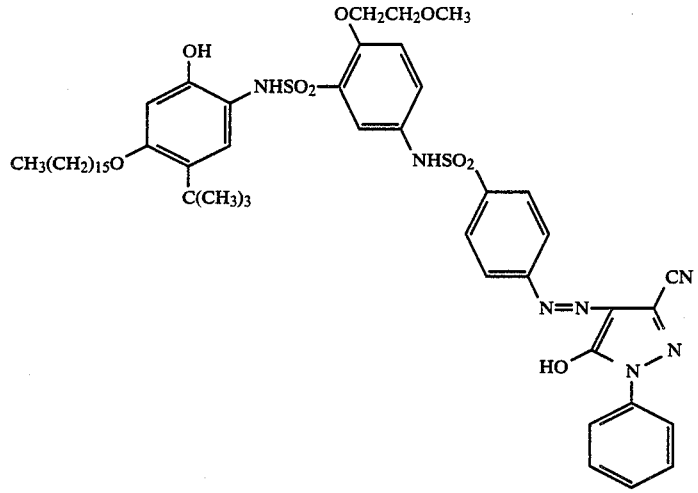

(13) A layer containing a blue-sensitive internal latent image-type direct reversal silver bromide emulsion (1.09 g/m$^2$ as silver amount), 1.1 g/m$^2$ of gelatin, 0.04 g/m$^2$ of the nucleating agent as used in Layer (7) above, and 0.07 g/m$^2$ of 2-sulfo-5-n-pentadecylhydroqunone.-sodium salt.

(14) A protective layer containing 0.5 g/m$^2$ of gelatin and a polymethyl methacrylate latex (having a mean particle size of 4 μm).

Cover Sheet

Same as in Example 1.

| Processing Liquid | |
|---|---|
| 1-p-Tolyl-4-hydroxymethyl-4-methyl-3-pyrazolidinone | 12 g |
| Methyl Hydroquinone | 0.1 g |
| 5-Methylbenzotriazole | 3.5 g |
| Sodium Sulfite (anhydrous) | 0.2 g |
| Carboxymethyl Cellulose.Na Salt | 43 g |
| Potassium Hydroxide | 56 g |
| Benzyl Alcohol | 1.5 ml |
| Carbon Black | 150 g |
| Water to make | 1 kg |

The above-described processing liquid was filled in a rupturable container capable of shielding oxygen, and the container was mounted between the light-sensitive sheet and the cover sheet in unity in such a manner that when a pressing force was applied to the container by pressure-applying members, the processing liquid in the container was released between the light-sensitive sheet and the cover sheet constituting the film unit.

The processing liquid was spread therebetween in each of unexposed photographic elements 1A to 5A at a thickness of 80 μm at 25° C. Three sheets were used for each sample. After 5 minutes, an overall black transferred image was obtained for each sheet.

When each sample was stored under the conditions shown in Table 2 below after processing, followed by separating from each other, the sample could be separated at the peel-off layer. That is, the upper mordant layer and the lower mordant layer were separated to different supports, the density of the mordanted dye in the upper mordant layer could be measured as a reflection type with the light-reflection layer containing titanium dioxide as the background, and, on the other hand, the density of the mordanted dye in the lower mordant layer left on the support for the light-sensitive sheet could be measured as a transmission type. By previously determining the relation between the transmission density or reflection density and the amount of dye as a calibration curve, the density thus measured was converted into the amount of dye mordanted to each layer and then the ratio (upper layer mordanting ratio) of the amount of dye in the upper mordant layer to the total amount of the dyes in both the mordant layers was obtained. The results are shown in Table 2.

When the upper mordanting ratio is 50%, mordanting is uniform, the value of higher than 50% shows a better selectivity for the upper mordant layer, and the value of lower than 50% shows a better selectivity for the lower mordant layer.

TABLE 2

| | | | | | Upper Mordanting Ratio (%) | | | | | | | | |
|---|---|---|---|---|---|---|---|---|---|---|---|---|---|
| | Lower Mordant Layer | | Upper Mordant Layer | | After 1 hour | | | After 14 Days, Room Temp. | | | After 3 Days 35° C. 80% RH | | |
| No. | Mordant | Gelatin | Mordant | Gelatin | Y | M | C | Y | M | C | Y | M | C |
| 1A | IIa-2 3 g | 3 g | — | — | 0 | 0 | 0 | 0 | 0 | 0 | 0 | 0 | 0 |
| 2A | Ia-3 3 g | 3 g | — | — | 0 | 0 | 0 | 0 | 0 | 0 | 0 | 0 | 0 |
| 3A | IIa-2 2 g | 2 g | Ia-3 1 g | 1 g | 10 | 5 | 100 | 0 | 0 | 98 | 0 | 0 | 91 |
| 4A | IIa-2 1 g | 1 g | Ia-3 2 g | 2 g | 30 | 21 | 100 | 7 | 5 | 99 | 7 | 0 | 98 |
| 5A | IIa-2 1.5 g | 2.25 | Ia-3 1.5 g | 0.75 g | 27 | 18 | 100 | 5 | 2 | 99 | 1 | 0 | 97 |

Sample Nos. IA–2A: Comparison samples
Sample Nos. 3A–5A: Samples of the invention As is clear from the results of Table 2 above, in the photographic elements of this invention, a cyan dye is preferentially mordanted to mordant (I) and each of magenta and yellow dyes is selectively mordanted to mordant (II). It is very important in practical use that the selectively mordanted state is maintained during the storage of the mordanted dye images for a long period of time.

On the other hand, a thin strip was cut from each of photographic elements 1A to 5A in the non-separated state and the section was observed by an optical microscope (well known as a section photograph in the field of art). By the results thereof, the selective mordanting states were also confirmed in the section photograph as the cases of the aforesaid peel-off method.

EXAMPLE 3

Light-sensitive sheets 1B to 5B were prepared in the same manners as the cases of preparing light-sensitive sheets 1A to 5A, respectively, in Example 2, except that Layer (2) was not formed in each case, and the photographic performance of each sample was determined by the following methods. The processing liquid and the cover sheet were the same as in Example 2.

First, for determining light fastness, each sample which was light-exposed through a continuous gradation wedge and processed by spreading the processing liquid was dried at 40° C. and 30% relative humidity (RH) and after measuring the density thus obtained, the sample was light-exposed using a fluorescent fade-o-meter. Thereafter, the density was measured again. The residual ratio of each dye was determined from the densities before and after the light exposure. The results obtained are shown in Table 3 below.

Then, each of light-sensitive sheets 1B to 5B was light-exposed through a wedge for resolving power test changing frequency, processed by spreading the processing liquid, and the density was measured using a microdensitometer. From the data thus obtained, the space frequency that MTF (modulation transfer function) of magenta dye was determined and the results obtained are shown in Table 3 below. Details of MTF are described in T. James, *The Theory of Photographic Process*, 4th Edition, pages 604–607, published by Macmillan Publishing Co., New York.

Also, for determining the transfer speed, directly after processing each of light-exposed light-sensitive sheets 1B to 5B by spreading the processing liquid, the change in density with the passage of time was measured by means of a Macbeth densitometer and the time required to reach a density of 50% was calculated. The results thus obtained are shown in Table 3 below.

Furthermore, when the mordant layers after processing were observed by the section photographic method described in Example 2, it was confirmed that they were selectively mordanted as in Example 2.

From the results shown in Table 3, it can be clearly seen that the photographic elements of this invention are excellent in light fastness (less light fading), sharpness, and transfer speed as compared with the comparison samples (conventional elements). It is a particularly astonishing advantage of this invention that the photographic elements are simultaneously excellent in the aforesaid three characteristics.

Also, when mordanting of dyes is selectively performed by the two layers containing mordant (I) and mordant (II), respectively according to this invention, the result is unexpectedly superior to the case of employing mordant (I) or mordant (II) individually.

While the invention has been described in detail and with reference to specific embodiments thereof, it will be apparent to one skilled in the art that various changes and modifications can be made therein without departing from the spirit and scope thereof.

What is claimed is:

1. A color photographic light-sensitive material having on a support silver halide emulsion layers associated with a yellow dye-providing compound, a magenta dye-providing compound, and a cyan-dye providing compound, and having thereon on the same support or having on a different support an image-receiving layer, said image-receiving layer comprising (1) a first image-receiving layer containing at least one kind of a cyclic quaternary ammonium mordant (I) having a quaternary ammonium salt moiety of a saturated cyclic amine or pyridine as a recurring unit for preferentially mordanting a cyan dye released or formed from said cyan dye-providing compound as a result of development and (2) a second image-receiving layer containing at least one kind of a quaternary ammonium mordant (II) having a quaternary ammonium salt moiety of an acyclic amine as a recurring unit for selectively mordanting a magenta dye and a yellow dye released or formed from said magenta dye-providing compound and said yellow dye-providing compound, respectively, as a result of development.

2. A color photographic light-sensitive material as in claim 1, wherein said mordant (I) is a homopolymer or a copolymer having a recurring unit represented by formula (Ia)

TABLE 3

| | Content of Mordant Layer | | | | Light fastness(1) (Residual ratio (%)) | | | Sharpness(2) (MTF 5%) | | | Transfer(3) Speed |
|---|---|---|---|---|---|---|---|---|---|---|---|
| No. | Lower Mordant Layer | | Upper Mordant Layer | | Y | M | C | Y | M | C | T50% |
| 1B | IIa-2 | 3 g/m² | | — | 89 | 78 | 43 | 2.7 | 3.1 | 4.8 | 59 sec |
| | Gelatin | 3 | | — | | | | | | | |
| 2B | Ia-3 | 3 | | — | 94 | 89 | 65 | 2.4 | 2.5 | 4.9 | 65 sec |
| | Gelatin | 3 | | — | | | | | | | |
| 3B | IIa-2 | 2 | Ia-3 | 1 g | 97 | 92 | 77 | 3.1 | 3.3 | 4.9 | 58 sec |
| | Gelatin | 2 | Gelatin | 1 | | | | | | | |
| 4B | IIa-2 | 1 | Ia-3 | 2 | 97 | 94 | 77 | 3.0 | 3.0 | 4.8 | 59 sec |
| | Gelatin | 1 | Gelatin | 2 | | | | | | | |
| 5B | IIa-2 | 1.5 | Ia-3 | 1.5 | 97 | 91 | 75 | 3.1 | 3.1 | 4.9 | 58 sec |
| | Gelatin | 2.25 | Gelatin | 0.75 | | | | | | | |

(1)Fluorescent lamp exposure of 14 days at 17,000 lux; initial density 1.0: the higher residual ratio is better.
(2)Stored for 3 days at 50° C., 80% RH after 1 day since processing; the larger value is better.
(3)Time for requiring green density reaching 50%; the smaller value is better. Sample Nos. IB and 2B: Comparison samples. Sample Nos. 3B to 5B: Samples of the invention.

(Ia)

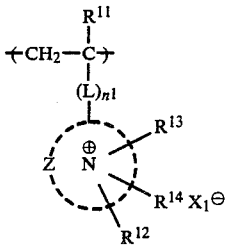

wherein $R^{11}$ represents a hydrogen atom or an alkyl group; $R^{12}$ represents an alkyl group, a substituted alkyl group, or an aralkyl group, said group bonding to the quaternary nitrogen atom of a saturated cyclic amine or pyridine; $R^{13}$ and $R^{14}$ each represents a hydrogen atom, a halogen atom, an alkyl group, a substituted alkyl group, an aralkyl group, or an aryl group; L represents a divalent linking group; $n^1$ represents 1 or 0; Z represents an atomic group forming a quaternary ammonium ion of a saturated cyclic amine or pyridine; and $X_1\ominus$ represents an acid group forming a salt together with a quaternary ammonium ion.

3. A color photographic light-sensitive material as in claim 1, wherein said mordant (I) is a homopolymer or a copolymer having a recurring unit represented by formula (Ib)

(Ib)

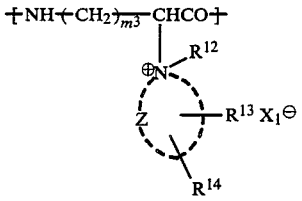

wherein $R^{12}$ represents an alkyl group, a substituted alkyl group, or an aralkyl group, said group bonding to the quaternary nitrogen atom of a saturated cyclic amine or pyridine; $R^{13}$ and $R^{14}$ each represents a hydrogen atom, a halogen atom, an alkyl group, a substituted alkyl group, an aralkyl group, or an aryl group; L represents a divalent linking group; Z represents an atomic group forming a quaternary ammonium ion of a saturated cyclic amine or pyridine; $X_1\ominus$ represents an acid group forming a salt together with a quaternary ammonium ion; and $m^3$ represents an integer of 1 to 10.

4. A color photographic light-sensitive material as in claim 1, wherein said mordant (II) is a homopolymer or a copolymer having a recurring unit represented by formula (IIa)

(IIa)

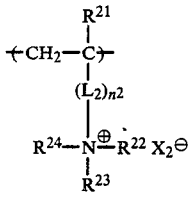

wherein $R^{21}$ represents a hydrogen atom or an alkyl group; $R^{22}$ represents an alkyl group, a substituted alkyl group, or an aralkyl group, said group bonding to the quaternary nitrogen atom; $R^{23}$ and $R^{24}$ each represents a hydrogen atom, a halogen atom, an alkyl group, a substituted alkyl group, an aralkyl group, or an aryl group; $L_2$ represents a divalent linking group; $n^2$ represents 1 or 0; and $X_2\ominus$ represents an acid group forming a salt together with a quaternary ammonium ion.

5. A color photographic light-sensitive material as in claim 1, wherein said mordant (II) is a homopolymer or a copolymer having a recurring unit represented by formula (IIb)

(IIb)

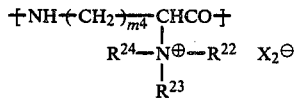

wherein $R^{22}$ represents an alkyl group, a substituted alkyl group, or an aralkyl group, said group bonding to the quaternary nitrogen atom; $R^{23}$ and $R^{24}$ each represents a hydrogen atom, a halogen atom, an alkyl group, a substituted alkyl group, an aralkyl group, or an aryl group; $X_2\ominus$ represents an acid group forming a salt together with a quaternary ammonium ion; and $m^4$ represents an integer of 1 to 10.

6. A color photographic light-sensitive material as in claim 2, wherein said mordant (I) is a homopolymer or a copolymer having a recurring unit represented by formula (Iaa)

(Iaa)

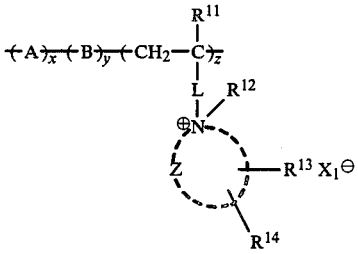

wherein A represents a crosslinking monomer; B represents a copolymerizable ethylenically unsaturated monomer Z, $R^{11}$, L, $R^{12}$, $R^{13}$, $R^{14}$, and $X_1\ominus$ are the same as defined in claim 2; x represents from 0.2 to 15 mole%; y represents from 0 to 90 mole%; and z represents from 5 to 99 mole%.

7. A color photographic light-sensitive material as in claim 2, wherein said mordant (I) is a homopolymer or a copolymer having a recurring unit represented by formula (Iab)

(Iab)

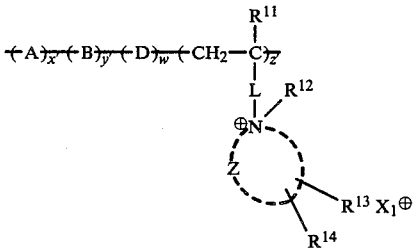

wherein A represents a crosslinking monomer; B represents a copolymerizable ethylenically unsaturated monomer; Z, $R^{11}$, L, $R^{12}$, $R^{13}$, $R^{14}$, and $X_1\ominus$ are the same as defined in claim 2; D represents an acrylonitrile or a derivative thereof represented by formula (III)

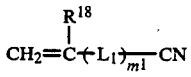

(III)

wherein $R^{18}$ represents a hydrogen atom or an alkyl group, $L_1$ represents an alkylene group or an arylene group, and $m^1$ represents 0 or 1; x' represents from 0 to 10 mole%; y' represents from 0 to 80 mole%; w represents from 5 to 90 mole%; and z' represents from 10 to 90 mole%.

8. A color photographic light-sensitive material as in claim 4, wherein said mordant (II) is a homopolymer or a copolymer having a recurring unit represented by formula (IIaa)

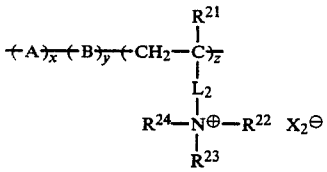

(IIaa)

wherein A represents a crosslinking monomer; B represents a copolymerizable ethylenically unsaturated monomer; $R^{21}$, L, $R^{22}$, $R^{23}$, $R^{24}$, and $X_2\ominus$ are the same as defined in claim 4; x represents from 0.2 to 15 mole%; by represents from 0 to 90 mole%; and z represents from 5 to 99 mole%.

9. A color photographic light-sensitive material as in claim 4, wherein said mordant (II) is a homopolymer or a copolymer having a recurring unit represented by formula (IIab)

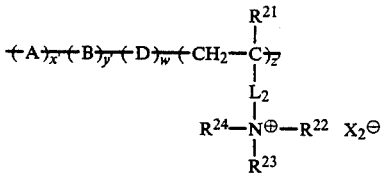

(IIab)

wherein A represents a crosslinking monomer; B represents a copolymerizable ethylenically unsaturated monomer; $R^{21}$, L, $R^{22}$, $R^{23}$, $R^{24}$, and $X_2\ominus$ are the same as defined in claim 4; D represents an acrylonitrile or a derivative thereof represented by formula (III)

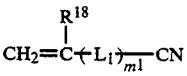

(III)

wherein $R^{18}$ represents a hydrogen atom or an alkyl group, $L_1$ represents an alkylene group or an arylene group, and $m^1$ represents 0 or 1; x' represents from 0 to 10 mole%; y' represents from 0 to 80 mole%; w represents from 5 to 90 mole%; and z' represents from 10 to 90 mole%.

10. A color photographic light-sensitive material as in claim 2, wherein $R^{11}$ represents a hydrogen atom or an alkyl group having from 1 to 6 carbon atoms; and $R^{12}$ represents an alkyl group, a substituted alkyl group, or an aralkyl group having from 7 to 20 carbon atoms.

11. A color photographic light-sensitive material as in claim 3, wherein $R^{12}$ represents an alkyl group, a substituted alkyl group, or an aralkyl group having from 7 to 20 carbon atoms.

12. A color photographic light-sensitive material as in claim 4, wherein $R^{21}$ represents a hydrogen atom or an alkyl group having from 1 to 6 carbon atoms; and $R^{22}$ represents an alkyl group, a substituted alkyl group, or an aralkyl group having from 7 to 20 carbon atoms.

13. A color photographic light-sensitive material as in claim 5, wherein $R^{22}$ represents an alkyl group, a substituted alkyl group, or an aralkyl group having from 7 to 20 carbon atoms.

14. A color photographic light-sensitive material as in claim 2, wherein L represents a divalent group represented by

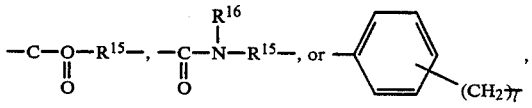

wherein l is 1 or 2; $R^{15}$ represents an alkylene group, an arylene group, or an aralkylene group represented by

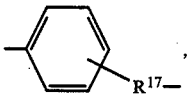

wherein $R^{17}$ represents an alkylene group having from 1 to about 6 carbon atoms; $R^{16}$ represents a hydrogen atom, an alkyl group, a substituted alkyl group, or an aralkyl group, said group bonding to the quaternary nitrogen atom of a saturated cyclic amine or pyridine.

15. A color photographic light-sensitive material as in claim 4, wherein $L_2$ represents a divalent group represented by

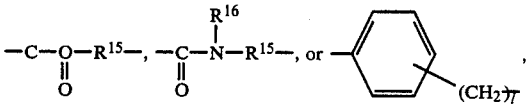

wherein l is 1 or 2; $R^{15}$ represents an alkylene group, an arylene group, or an aralkylene group represented by

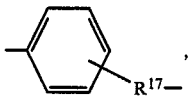

wherein $R^{17}$ represents an alkylene group having from 1 to about 6 carbon atoms; $R^{16}$ represents a hydrogen atom, an alkyl group, a substituted alkyl group, or an aralkyl group, said group bonding to the quaternary nitrogen atom.

16. A color photographic light-sensitive material as in claim 1, wherein the amount of each of mordant (I) and mordant (II) is from about 40 to 60% by weight based on the weight of the respective image-receiving layer in which each of mordant (I) and mordant (II) is incorporated.

17. A color photographic light-sensitive material as in claim 3, wherein the amount of each of mordant (I) and mordant (II) is from about 40 to 60% by weight based on the weight of the respective image-receiving layer in which each of mordant (I) and mordant (II) is incorporated.

18. A color photographic light-sensitive material as in claim 1, wherein the coverage of each of mordant (I) and mordant (II) is from about 1 to 5 g/m$^2$.

19. A color photographic light-sensitive material as in claim 2, wherein the coverage of each of mordant (I) and mordant (II) is from about 1 to 5 g/m$^2$.

20. A color photographic light-sensitive material as in claim 3, wherein the coverage of each of mordant (I) and mordant (II) is from about 1 to 5 g/m$^2$.

* * * * *